US007194775B2

(12) United States Patent
Leung

(10) Patent No.: US 7,194,775 B2
(45) Date of Patent: Mar. 27, 2007

(54) SHOWER DEVICE WITH MULTIPLE MOVABLE ARMS

(75) Inventor: Anthony Kit Lun Leung, North Point (HK)

(73) Assignee: Conair Corporation, Stamford, CT (US)

( * ) Notice: Subject to any disclaimer, the term of this patent is extended or adjusted under 35 U.S.C. 154(b) by 363 days.

(21) Appl. No.: 10/962,030

(22) Filed: Oct. 8, 2004

(65) Prior Publication Data

US 2005/0086737 A1 Apr. 28, 2005

Related U.S. Application Data

(60) Provisional application No. 60/511,027, filed on Oct. 13, 2003.

(51) Int. Cl.
*A47K 3/022* (2006.01)

(52) U.S. Cl. ..... 4/601; 4/567

(58) Field of Classification Search ..... 4/567–570, 4/601, 615; 239/587.2, 587.5, 587.6, 556
See application file for complete search history.

(56) References Cited

U.S. PATENT DOCUMENTS

| | | | | | |
|---|---|---|---|---|---|
| 833,527 | A | * | 10/1906 | Jackson | 4/570 |
| 1,354,838 | A | * | 10/1920 | Perkins | 4/568 |
| 1,616,514 | A | * | 2/1927 | Swimmer | 4/570 |
| 1,758,115 | A | * | 5/1930 | Kelly | 239/282 |
| 3,971,074 | A | * | 7/1976 | Yxfeldt | 4/570 |
| 4,397,050 | A | * | 8/1983 | Davis et al. | 4/601 |
| 4,975,993 | A | * | 12/1990 | Black et al. | 4/601 |
| 5,230,472 | A | * | 7/1993 | McCabe | 239/443 |

* cited by examiner

*Primary Examiner*—Charles E. Phillips
(74) *Attorney, Agent, or Firm*—Lawrence Cruz; Steven A. Garner

(57) ABSTRACT

A shower device having multiple heads and multiple settings that can be selectively set and selectively aimed among various modes, including massaging modes. The shower device contains an attachment mechanism to attach and suspend the device from a standard shower head stem, a linearly adjustable body member that adjusts in an extendible manner relative to a main body, first and second pivot arms that are pivotally attached to the main body, and a hinge for allowing relative pivoting of an arm head. A valve controller controls one or more valves to allow a user to select among a variety of shower output options.

8 Claims, 2 Drawing Sheets

SHOWER DEVICE WITH MULTIPLE MOVABLE ARMS

CROSS-REFERENCE TO RELATED APPLICATIONS

This application claims priority to U.S. Provisional Patent Application Ser. No. 60/511,027 filed on Oct. 13, 2003, incorporated herein by reference in its entirety.

BACKGROUND OF THE INVENTION

1. Field of the Invention

The present invention relates to shower devices and, more particularly, to a novel device having shower arms that are selectively actuated and movable in a variety of ways.

2. Description of Related Art

It is known in the art to employ shower heads with multiple settings and, in some instances, with multiple heads. While a variety of configurations exist for such showerheads, most are limited in water output in terms of span of area covered by the water spray and varying options for the user to select from a narrow output to a wide output, with the ability to aim the water output. Some of the known designs are not readily or easily retrofitted on existing showers.

There is a need therefore, for an improved shower device that has a wide range of selectable water output in terms of spray area as well as spray aim, and that is easily and readily retrofitted or adapted to existing shower systems.

OBJECT AND SUMMARY OF THE INVENTION

It is an object of the present invention to overcome the shortcomings of the prior art mentioned above. These and other objects are achieved by the present invention described herein.

The present invention is directed to a multiple-setting and multiple head shower device that can be selectively set and selectively aimed among various modes, including massaging modes.

BRIEF DESCRIPTION OF THE DRAWINGS

The present invention is more fully understood by reference to the following detailed description of an illustrative embodiment with the drawings identified below.

DETAILED DESCRIPTION OF THE INVENTION

Figure 1:
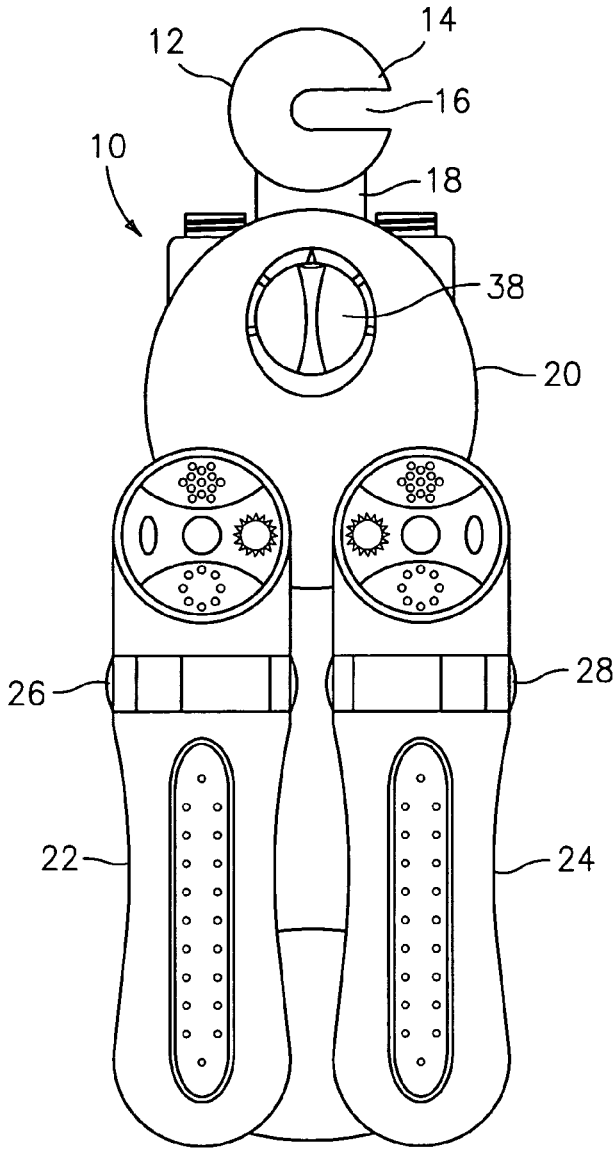
FIG. 1 is a front view of a shower device according to the present invention shown in one positional mode.
Figure 2:
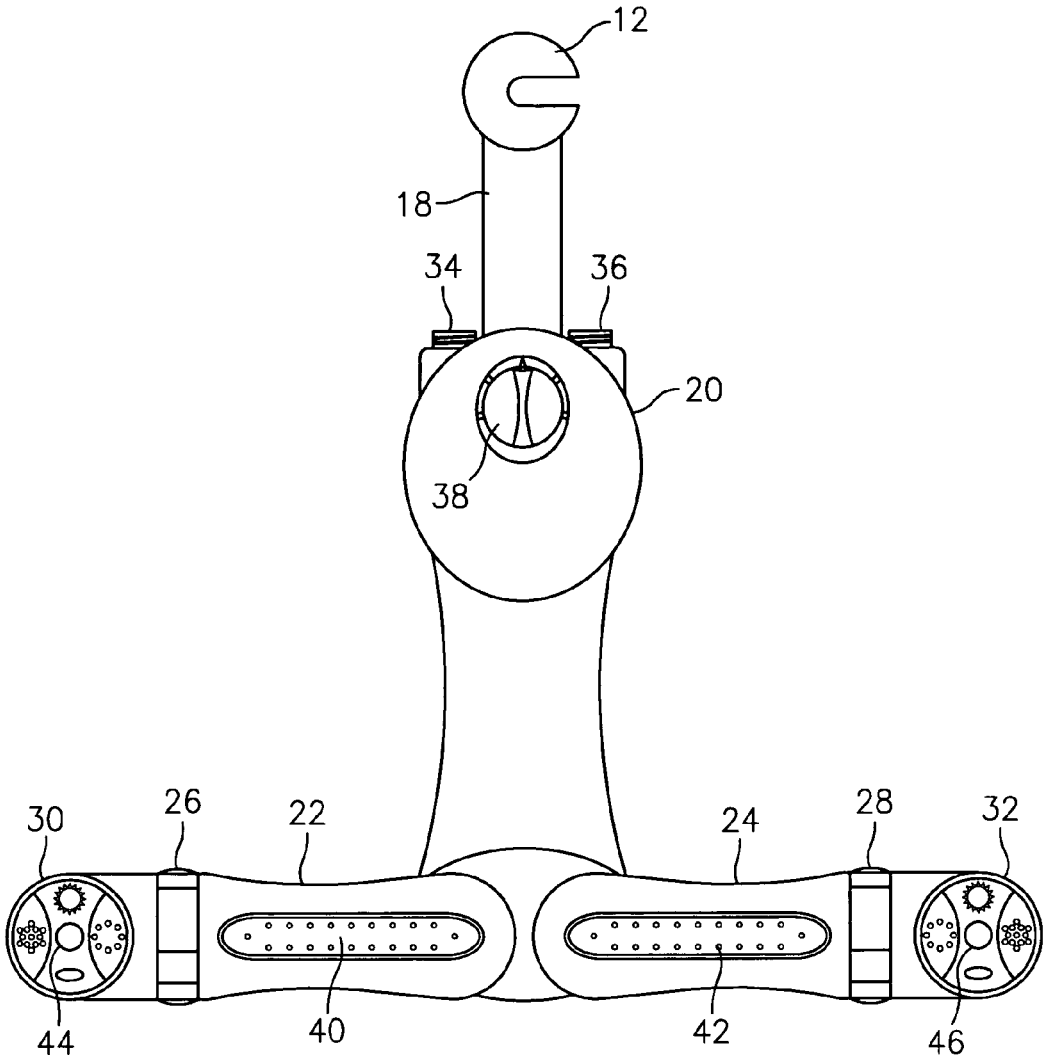
FIG. 2 is a front view of the shower device of FIG. 1 shown in another positional mode.
Figure 3:
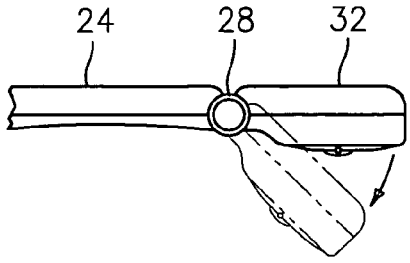
FIG. 3 is a partial, top view of the device shown in FIGS. 1–2.

Referring to FIGS. 1–2, the preferred embodiment of the present invention of a shower device (10) is shown. The shower device (10) comprises an attachment mechanism (12) that is adapted to attach and suspend the device (10) from a standard shower head stem (not shown) that extends from a wall of a shower. The attachment mechanism (12) has a circular profiled body half (14) and an opening (16) that receives the stem. A second body half (not shown), is similar in size and shape to the first body half (14) and is pivotally attached to the first body half (14) through a common center point. When the second body half is rotated relative to the first body half (14), it traps the stem so that it cannot slip out of the opening (16). Suction cups (not shown) can be provided on the back of the body (20) to additionally secure the device (10) to a shower wall. A linearly adjustable body member (18) is provided that adjusts in an extendible manner relative to a main body (20). The body (20) and member (18) utilize ratchet mechanisms of the type known to those skilled in the art to achieve linear adjustability between the positions shown in FIG. 1 and in FIG. 2. First and second pivot arms (22, 24) are pivotally attached to the main body (20) to pivot between the positions shown in FIG. 1 and in FIG. 2, and to further pivot an additional 90 degrees so that the pivot arms (22, 24) travel a full 180 degrees from the position shown in FIG. 1. Near the distal end of each pivot arm (22, 24) is a hinge (26, 28) for allowing relative pivoting of an arm head (30, 32), as shown in FIG. 3.

A variety of shower heads are adapted to deliver water selectively. The device (10) is attached to a hose (not shown) running from the standard shower head stem (not shown) or an adaptor, as explained below, into the water inlet (34). Preferably, a standard bifurcated shower pipe adaptor of the type generally known is attached to the stem so that the standard head (not shown) and the hose can be attached to the adaptor, enabling selective flow through either. Instead of a standard shower head, a handheld or other type of shower head may be attached. A water outlet (36) allows flow from the inlet (34), through the device (10), and back out of the outlet (36) into a standard shower head (not shown) or the adaptor, if used.

Figure 5:
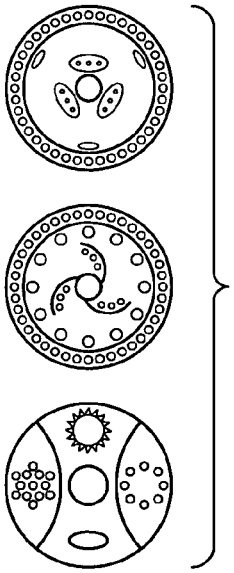
FIGS. 4–5 are front views of various shower spray hole patterns for use with the present invention.
Figure 4:
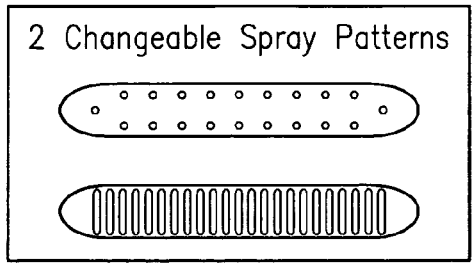

A valve controller (38) that controls one or more valves of the type generally known (not shown) that are housed in the body (20) is provided. A user can selectively move the controller among various positions to control a variety of shower output options. In the preferred embodiment, there are at least five settings as follows. A first setting controls the valve or valves to direct water through only the standard shower head (not shown) attached to the bifurcated adaptor extending from the shower wall. A second setting enables the water flow to be directed through the standard shower head as well as arm nozzles (40, 42) located on the pivot arms (22, 24). A third setting enables water flow to be directed through the arm head nozzles (44, 46) located on the pivot arm heads (30, 32). A fourth setting enables the water flow to be directed though the arm nozzles (40, 42) and the head nozzles (44, 46) simultaneously. A fifth setting enables the water flow to be directed through the standard shower head and the head nozzles (44, 46) simultaneously. It is contemplated that other flow patterns, such as right side only or left side only can be implemented with the structure of the device (10) of the present invention by altering the valves and controls. A variety of nozzle patterns for all of the nozzles and heads mentioned herein can be implemented to achieve any one of a number of spray patterns including massaging spray patterns. Such spray patterns are disclosed in FIGS. 4 and 5.

While a preferred embodiment of the invention has been herein disclosed and described, it is understood that various modifications can be made without departing from the scope of the invention.

What is claimed is:

1. A shower device comprising:

a housing;

at least one arm pivotally attached to said housing;

a first nozzle on said at least one arm near the end of said arm adjacent said housing;

a second nozzle on said at least one arm near the end of said arm opposite said housing;

a hinge between said first nozzle and said second nozzle adapted to enable said second nozzle to pivot with respect to said first nozzle about an axis that is perpendicular to a longitudinal axis of said arm; and an inlet on said housing adapted to transfer water to said device.

2. A shower device according to claim 1, further comprising an outlet on said housing adapted to transfer water out from said device toward a main shower head.

3. A shower device according to claim 1, further comprising a mechanism adapted to attach said device to a shower head stem.

4. A shower device according to claim 3, wherein said mechanism comprises a first body part having an opening.

5. A shower device according to claim 3, further comprising a member connecting said mechanism to said housing and adapted to be linearly extendable relative to said housing to selectively set said housing at one of a plurality of distances from said shower head stem.

6. A shower device according to claim 1, further comprising a valve controller adapted to control one or more valves to selectively direct water to any of said first nozzle on said at least one arm, said second nozzle on said at least one arm, said main shower head, or any combination thereof.

7. A shower device according to claim 1, wherein said first nozzle is interchangeable with other nozzles having different spray patterns.

8. A shower device according to claim 1, wherein said second nozzle is interchangeable with other nozzles having different spray patterns.

* * * * *